US008833995B2

(12) United States Patent
Frost et al.

(10) Patent No.: US 8,833,995 B2
(45) Date of Patent: Sep. 16, 2014

(54) LIGHTING MODULE

(75) Inventors: Tobias Frost, Burglengenfeld (DE); Stefan Lorenz, Obertraubling (DE); Peter Sachsenweger, Zeitlarn (DE); Simon Schwalenberg, Donaustauf (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/513,840

(22) PCT Filed: Nov. 17, 2010

(86) PCT No.: PCT/EP2010/067625

§ 371 (c)(1), (2), (4) Date: Jun. 4, 2012

(87) PCT Pub. No.: WO2011/067113

PCT Pub. Date: Jun. 9, 2011

(65) Prior Publication Data

US 2012/0243254 A1 Sep. 27, 2012

(30) Foreign Application Priority Data

Dec. 4, 2009 (DE) ..... 10 2009 047 481

(51) Int. Cl.
*G02B 6/00* (2006.01)

(52) U.S. Cl.
USPC ..... 362/555; 362/498; 362/551

(58) Field of Classification Search
CPC ..... F21K 9/00
USPC ..... 362/234, 253, 296.01, 296.1, 296.04, 362/294, 551, 555
See application file for complete search history.

(56) References Cited

U.S. PATENT DOCUMENTS

| | | | | |
|---|---|---|---|---|
| 8,328,387 | B2 | 12/2012 | Hying et al. | |
| 2006/0226336 | A1 * | 10/2006 | York et al. | 250/206 |

FOREIGN PATENT DOCUMENTS

| | | |
|---|---|---|
| CN | 101548581 | 9/2009 |
| DE | 20 2007 009 272 | 11/2007 |
| DE | 10 2008 016095 | 10/2009 |
| WO | WO 2006/099732 | 9/2006 |
| WO | WO 2008/086890 | 7/2008 |
| WO | WO 2009/104125 | 8/2009 |
| WO | WO 2011/002508 | 1/2011 |

* cited by examiner

*Primary Examiner* — Elmito Breval
(74) *Attorney, Agent, or Firm* — Cozen O'Connor

(57) ABSTRACT

A lighting module, comprising a printed circuit board, which on the front side thereof, is populated by at least one light source as well as at least one light sensor; a hollow optical waveguide element, which laterally surrounds the at least one light source circumferentially; and a cover at least for the light sensor, arranged on the printed circuit board externally to the optical waveguide element, it being possible for a window to be located in the optical waveguide element to which window is connected a hollow light channel formed in and/or on the cover which leads to the light sensor.

17 Claims, 6 Drawing Sheets

LIGHTING MODULE

RELATED APPLICATIONS

This is a U.S. national stage of application No. PCT/EP2010/067625, filed on Nov. 17, 2010. Priority is claimed on the following application: German Application No. 10 2009 047 481.1, filed on Dec. 4, 2009, the content of which is hereby incorporated herein by reference.

FIELD OF THE INVENTION

The invention relates to a lighting module having a printed circuit board which, on the front side thereof, is populated by at least one light source, in particular a light emitting diode, as well as at least one light sensor.

BACKGROUND OF THE INVENTION

Lighting modules of the type mentioned in the introduction are known, in which light emitted by light emitting diodes is guided by means of a solid optical waveguide, for example an optical waveguide made of plexiglass, to a light sensor in order to sense a brightness and/or color of the light emitted by the light emitting diodes, for example. The measured values can be used, for example, to control the light emitting diodes in order to control brightness by suppressing brightness fluctuations, for example. However, manufacture of the solid optical waveguide involves costs, and assembly of the lighting module is also more complicated on account of the presence of the solid optical waveguide.

SUMMARY OF THE INVENTION

One object of the present invention is to avoid, at least to some extent, the disadvantages of the prior art and in particular offer a simple and economic option for guiding light radiated by a lighting module to a light sensor of the lighting module.

This and other objects are attained in accordance with one aspect of the present invention directed to a lighting module having a printed circuit board which, on the front side thereof, is populated by at least one light source, in particular a light emitting diode, as well as at least one light sensor and, furthermore, having a hollow optical waveguide element which laterally surrounds the at least one light source circumferentially and, further, having a cover at least for the light sensor arranged on the printed circuit board externally to the optical waveguide element, it being possible for a window to be located in the optical waveguide element to which window is connected a hollow light channel formed in and/or on the cover, which leads to the light sensor. The use of the hollow light channel allows a separately manufactured optical waveguide to be dispensed with, thus eliminating its manufacture and at least one assembly step. Rather, the light transmission to the light sensor can be realized by a suitable arrangement of existing components and therefore without additional production costs.

The light of the light source(s) is carried by means of the optical waveguide element from the plane of the light source (s) to a higher plane of the lighting module, that is to say to the plane of the light outlet opening. As a result, installation space required for electronic components, (capacitors, resistors, driver modules, etc.) can also be bridged and a new light outlet plane defined. Mounted elements (optical or optically active elements, etc.) can then be brought up as close as required to the light outlet opening which now acts as the new light emitting plane, thus avoiding coupling losses.

Since the optical waveguide element laterally surrounds the at least one light source circumferentially, this also includes the case where the optical waveguide element is displaced forwards with respect to the light source, that is to say it can have a (for the most part) small, vertical spacing from the at least one light source (more precisely: its emitter surface). However, to avoid light losses it is preferred if the optical waveguide element is not displaced forwards with respect to the light source.

Preferably, the at least one light source includes at least one light emitting diode. Where there is a plurality of light emitting diodes, these can illuminate in identical colors or different colors. A color can be monochromatic (for example red, green, blue, etc.) or multichromatic (for example white). The light radiated from the at least one light emitting diode can also be infrared light (IR LED) or ultraviolet light (UV LED). A plurality of light emitting diodes can produce mixed light; for example a white mixed light. The at least one light emitting diode can contain at least one wavelength-converting fluorescent material (conversion LED). The at least one light emitting diode can be in the form of at least one single-package light emitting diode or in the form of at least one LED chip. Several LED chips can be mounted on a common substrate ("submount"). The at least one light emitting diode can be equipped with at least one of its own and/or a common optical system for beam control, for example with at least one Fresnel lens, collimator, etc. In general, organic LEDs (OLEDs, for example polymer OLEDs) can be employed instead of or in addition to inorganic light emitting diodes, for example those based on InGaN or AlInGaP. Diode lasers can also be used, for example. Alternately, the at least one light emitting diode can include at least one diode laser, for example.

In one development, the plane of the light outlet opening lies parallel to a plane of the at least one light source. Consequently, the "optical interface" can simply be raised forwards from the plane of the light source(s) in which this or these is or are arranged, in the direction of the main direction of radiation or optical axis. Alternately, the plane of the light outlet opening can be bent at an angle to the plane of the at least one light source.

In another development, the optical waveguide element has essentially the basic form of a hollow cylinder. This form is particularly simple to manufacture and assemble.

In another development, the optical waveguide element can consist of an electrically non-conducting or dielectric material. Electrically-conducting mounted elements (for example aluminum reflectors) can be insulated from the electrically-conducting parts on the printed circuit board, which allows air gaps and creepage distances to be simply maintained. At the same time, the optical waveguide element can consist of a plastic, for example PC, PMMA, COC, COP, or of glass.

In one embodiment, the optical waveguide element has at least one reflecting region. In particular, one inner side of the optical waveguide element, which is directed towards the at least one light source, can be made reflecting, for example by a coating or a covering of a reflecting foil. For maximum low-loss light transmission in the light channel, the optical waveguide element can also have at least one reflecting region on its outside, in particular at least in a region which forms the light channel.

For maximum low-loss light transmission in the light channel, the covering can be made reflecting at least in one region which forms the light channel.

In another development, the optical waveguide element can have a (reflecting) inner side which extends forwards. The inner side can for example have an essentially truncated cone-shaped contour. This offers the advantage that the emission of the light beam emitted by the at least one light source can be collimated, which produces a narrower angular distribution. It has proved to be advantageous if an angular inclination $\alpha$ (also termed the "draft angle") lies in a range between 1° and 10°, in particular between 1° and 5° (including the upper range values).

In an alternate embodiment, the optical waveguide element has a forwards-tapering inner side, for example with an inverted truncated cone-shaped contour. This offers the advantage that the emission of the light beam emitted by the at least one light source can be decollimated, which produces a narrower angular distribution. It has proved to be advantageous if an angular inclination $\alpha$ lies in a range between −1° and −10°, in particular between −1° and −5° (including the upper range values).

In a further embodiment, the inner side of the optical waveguide element has an optically efficient surface texture. A mixed light can thus be realized in a simple and compact manner for example with regard to brightness and/or color of the light emitted by the at least one light source.

In one development, the surface texture includes a corrugated texture or is formed by means of such a texture. The corrugated texture can, for example include a sinusoidal type corrugated texture, but also a shape based on splines or even a free form. It has proved advantageous if a so-called "peak-to-valley" angle $\beta$ of the corrugated texture lies in a range [30'; 60°]. Alternately, other, general peak-to-valley texturing methods can be employed, for example in the form of a circumferential zigzag pattern.

In one development, the surface texture includes a roughened surface, for example an isotropic or anisotropic diffused surface. This offers the advantage that a directional mixed light can be realized with regard to an azimuth and/or polar angle.

The reflecting surface or inner side of the optical waveguide element can also be made entirely or partially single colored or multicolored, whereby one color of the emitted light can be colored.

Generally, the reflecting region of the optical waveguide element, for example its inner side, can be made mirrored or diffusely reflecting, for example by means of a coating or a foil. The coating or the foil can, for example, have at least one layer of aluminum, silver, a dielectric coating and/or barium sulfate, for example. The reflecting surface of the optical waveguide element, for example its inner side, can also have an optical film, for example a highly-reflecting mirror film or diffuser film (a so-called "Brightness Enhancement Film" BEF), or a coating of that type, which increases efficiency.

Moreover, in one embodiment, the window is a cut-out formed in the optical waveguide element. The cut-out can be continuous, which avoids light loss when light passes through, or the window can be covered with a light-transmitting, in particular transparent covering element, in order to protect an inner space or a volume of the cover.

In a further embodiment, the optical waveguide element consists, at least partially, of a light-transmitting, in particular transparent material and is covered by a non-transparent, in particular reflecting layer, it being possible for the window to be formed in a cut-out in the non-transparent layer. The reflecting layer can be placed on one inner side of a main body made of the light-transmitting material and/or on one outer side of this main body.

In a further embodiment, the window is located in one front third of the optical waveguide element. Therefore, compared to a deeper arrangement, a stronger luminous flux can be tapped off, which in addition, where there is a plurality of light sources, has a better mixture of the light of different light sources. In this case, a front region of the optical waveguide element is further away from the at least one light source than a lower or rear region. In other words, a front or upper region of the optical waveguide element has a greater vertical distance from the at least one light source than a lower or rear region.

In a further embodiment, the window has a vertical extension of at least 10% to 15% of the height of the optical waveguide element. Adequate luminous intensity is thus provided at the light sensor for its operation.

In a further embodiment, the optical waveguide element is electrically conductive; it is connected via a lower edge to the printed circuit board (directly or indirectly, for example via an insulating ring) and has at least one cut-out at the lower edge. Problems with electrical creepage paths can be avoided with the cut-out. The optical waveguide element can consist of a solid aluminum body.

In a further embodiment, the cover is an annular cover which surrounds the optical waveguide element circumferentially at least in sections and, in addition to the light sensor, covers further electronic components mounted on the printed circuit board. In other words, in a further embodiment the optical waveguide element is laterally surrounded circumferentially, at least in sections, by an annular cover for at least some of the electronic components located on the front side of the printed circuit board. In particular, a central, for example circular region for the at least one light source can thus be spatially isolated from this surrounding, in particular, annular region, in an especially compact and easy to install manner.

In a further embodiment, the optical waveguide element is a separate component from the cover, and is constructed in at least two parts. Due to the two-part or multi-part construction, complex geometries can be produced on the inner side and/or the outer side of the optical waveguide element in a comparatively simple manner.

Furthermore, in one embodiment, two adjacent parts of the optical waveguide element can be interconnected by means of a latching-type locking mechanism. Assembly is thus simple to arrange. However, adjacent parts can also be interconnected that is to say alternately or additionally, by other types of fastenings, for example by gluing.

For the case where the optical waveguide element consists of a light-transmitting, in particular transparent material and is covered with a non-transparent, in particular reflecting layer, it is possible for the window to be formed by a cut-out in the non-transparent layer, and in a further embodiment the window is formed by the at least one latching-type locking mechanism.

In a further embodiment, the optical waveguide element is integrated into the cover, thereby considerably simplifying manufacture. The manufacture of the combined cover/optical waveguide element can be carried out, for example by means of a multistage injection molding process. From a practical point of view, in this case the resulting integral light conduction range then corresponds to the optical waveguide element in a separate form of construction.

In another embodiment, the lighting module has at least one mounting means for receiving a mounted element over the light outlet opening. This mounting means can be used in particular for position adjustment of the mounted element with respect to the light outlet opening. In particular, the mounting means can also have a defined, ('standardized')

position for different lighting modules in relation to the light outlet opening, to be able to develop a design of mounted elements essentially independently of a design of such lighting modules (without the mounted element).

In a particular embodiment, the mounting means is configured as a fastening interface with a suitable arrangement in order to be able to fasten the mounted element to the lighting module in relation to the light outlet opening. The fastening interface can be a part of a bayonet lock, a screwed lock (generally a twist lock), a push-fit lock, etc.

BRIEF DESCRIPTION OF THE DRAWINGS

The invention is described in more detail with the aid of exemplifying embodiments in the following figures. For the sake of clarity, identical elements or those with identical operation are given the same reference numbers.

DETAILED DESCRIPTION OF THE DRAWINGS

Figure 1:
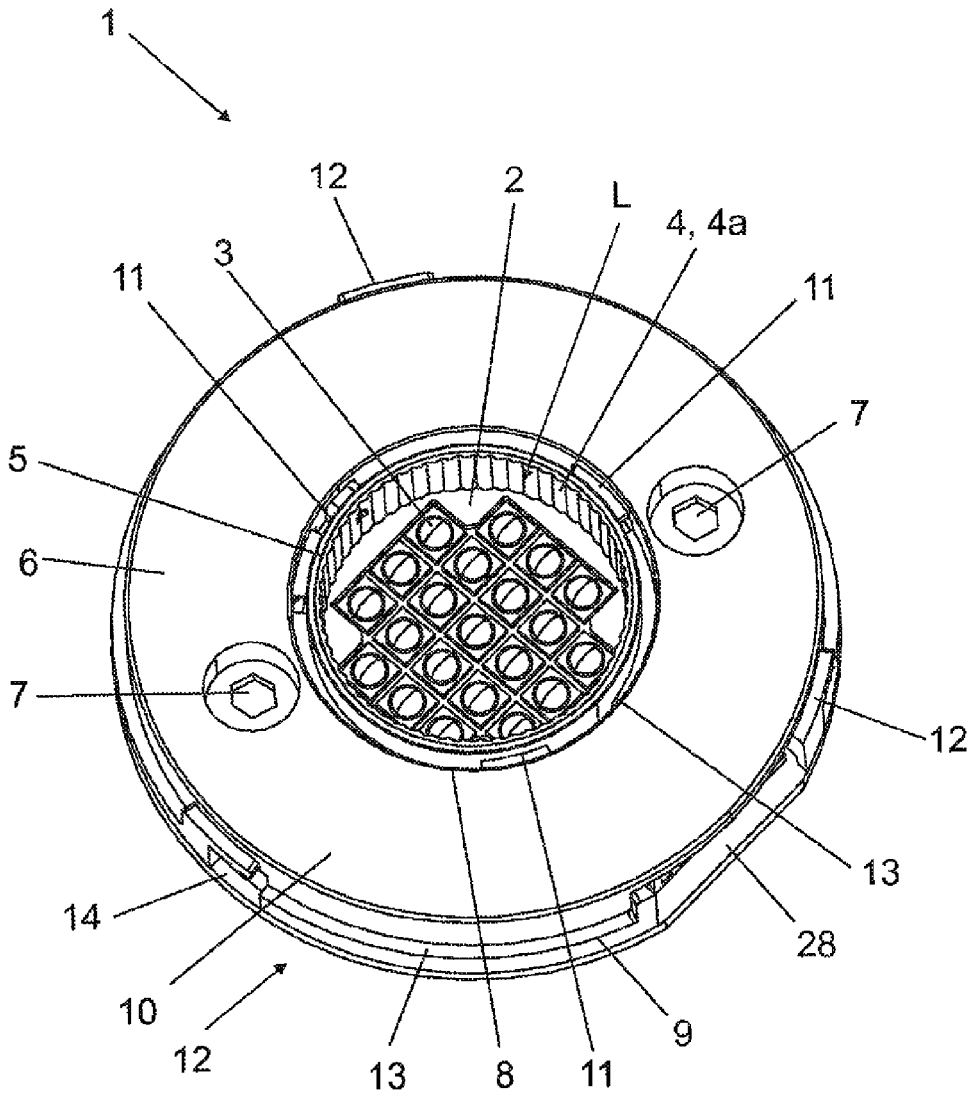
FIG. 1 shows an inclined front or plan view of an inventive lighting module without mounted element.
Figure 2:
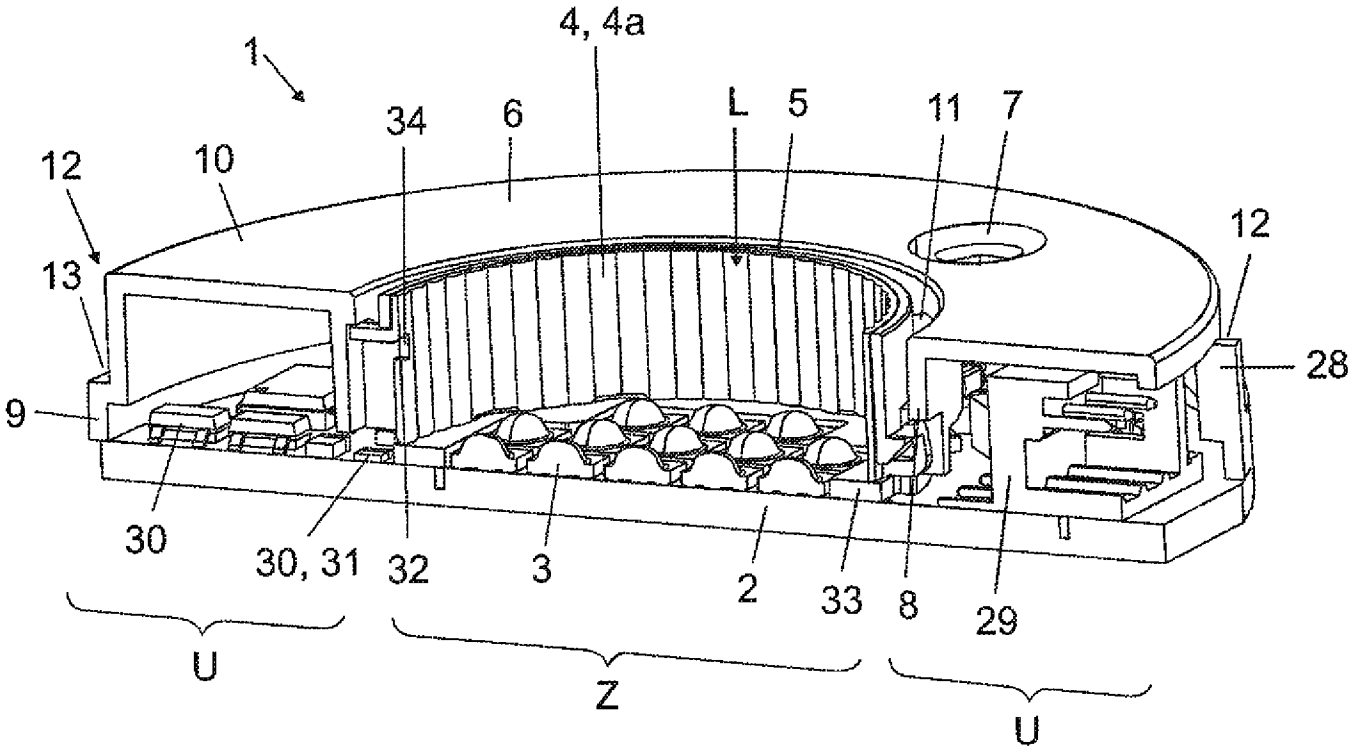
FIG. 2 shows an inclined sectional view of the lighting module.

FIG. 1 shows an inclined front or plan view of an inventive lighting module 1 without mounted element. FIG. 2 shows an inclined sectional view of the lighting module.

The lighting module 1 has an essentially disk-shaped printed circuit board 2, which is populated by a plurality of light sources in the form of light emitting diodes 3 in a central region Z of a front side. The light emitting diodes 3 can emit the same type of light or differ with respect to their brightness and/or color. An essentially hollow cylindrical optical waveguide element 4, that is common to the light emitting diodes which are arranged in a cruciform matrix pattern, laterally surrounds the light emitting diodes 3 circumferentially. A front edge 5 of the optical waveguide element 4 delimits and surrounds an essentially annular disk-shaped light outlet opening L. A back or rear edge 32 of the optical waveguide element 4 rests indirectly above an insulating ring 33 on the printed circuit board 2.

In other words the light outlet opening L corresponds to a front opening in the optical waveguide element 4. The inner side 4*a*, which is made reflecting and due to the hollow cylinder shape, stands straight or parallel, offers the advantage that an angular distribution of the light beam radiated by the light sources 3 is rotationally symmetric.

In a peripheral region U surrounding the central region Z, the printed circuit board 2 is populated by additional electronic components 30, for example resistors, capacitors and/or logic modules, for example as part of a logic driver unit. The additional electronic components 30 located in the peripheral region U are overarched by an annular cover 6 which rests with a rear edge on the printed circuit board 2. The annular cover 6 is attached by means of two screws 7 and has a plug lead-through 28 for making electrical contact with a plug connector 29 also mounted on the printed circuit board 2.

The annular cover 6 has an essentially cylindrical inner wall 8 (corresponding to an inner peripheral surface or inner side wall), which laterally and concentrically surrounds the central region Z of the lighting module 1 and therefore also the optical waveguide element 4. The annular cover 6 also has an essentially cylindrical outer wall 9 (corresponding to an outer peripheral surface or outer side wall). The outer wall 9 has the same height as the inner wall 8. The inner wall 8 and the outer wall 9 can rest with their rear edge on the printed circuit board 2 and at their front edge are joined by a top wall 10. In this case the top wall 10 is constructed as a circular, flat plate. The optical waveguide element 4 and the annular cover 6 can be separate components, interconnected components or wholly integrated.

A first fastening interface in the form of an inner bayonet socket 11 is integrated in the inner wall 8 of the annular cover 6. A second fastening interface in the form of an outer bayonet socket 12 is integrated in the outer wall 9 of the annular cover 6. Each of the bayonet sockets 11 and 12 has three longitudinal slots 13 accessible from the front, and a short attached transverse slot 14 at right-angles to the ends. The longitudinal slot 13 has a horizontal base and can also be used as a position adjustment aid. A mounted element can have a bayonet base matched to one of the bayonet sockets 11 or 12, said bayonet base being able to be plugged into the longitudinal slot 13 and able to be secured in the transverse slot 14 by rotation. The transverse slot 14 has a latching lug over which a corresponding locking lug 15 of the bayonet base can be slid for locking the bayonet socket and the bayonet base.

The light outlet opening L, the inner wall 8 and the outer wall 9 end at the same height. Consequently, the mounted element can be easily installed with the annular cover 6. In other words, the lighting module 1 has an essentially flat front side on which the annular cover 6 and the optical waveguide element 4 finish flush with the surface.

One of the electronic components 30 is a light sensor 31 that is intended to measure the light emitted by the light emitting diodes 3, for example in relation to a brightness and/or a color. So that the light sensor 31 is supplied or irradiated by a part of the light emitted by the light emitting diodes 3, a window 34 in the form of a rectangular cut-out is introduced into the optical waveguide element 4. The design of the lighting module 1 in relation to the light sensor 31 is described in more detail with reference to FIGS. 5 to 7.

The lighting module 1 can simply be fitted into a heatsink (not shown), for example by two-dimensional contact at its rear side, for example by inserting it into a suitable receptacle of the heatsink. This is a simple way of providing effective cooling.

Figure 3:
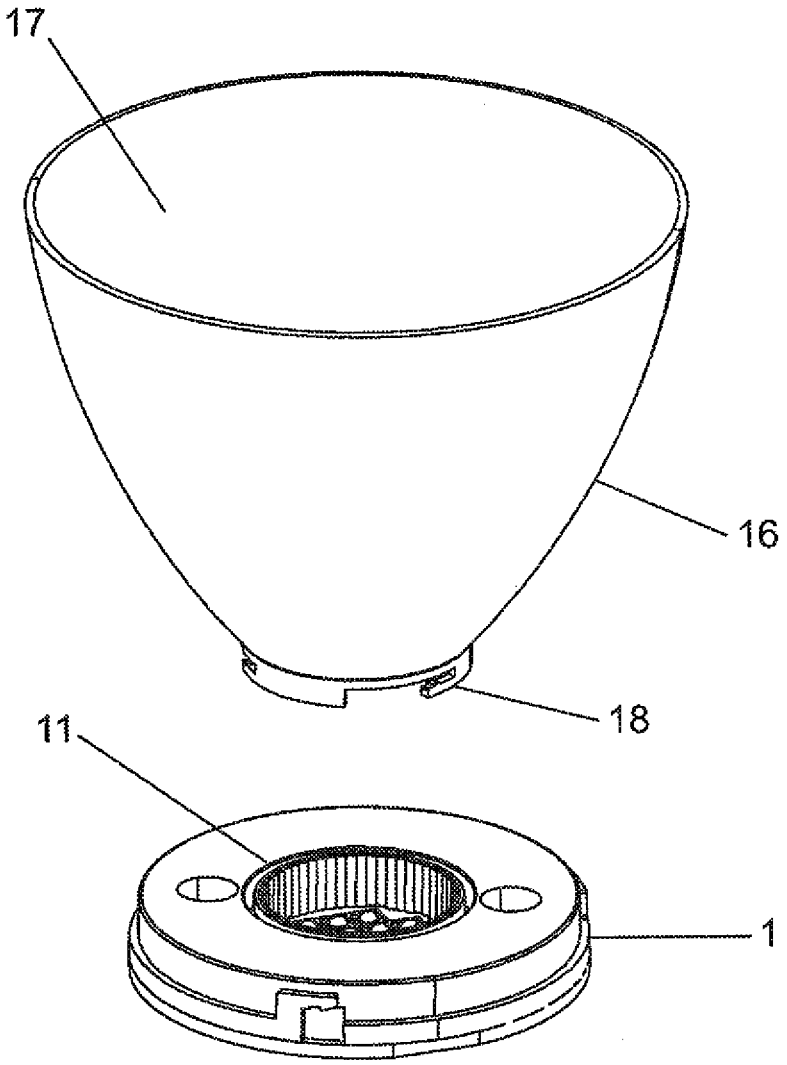
FIG. 3 shows an inclined view of the lighting module with a mounted element hanging above it.
Figure 4:
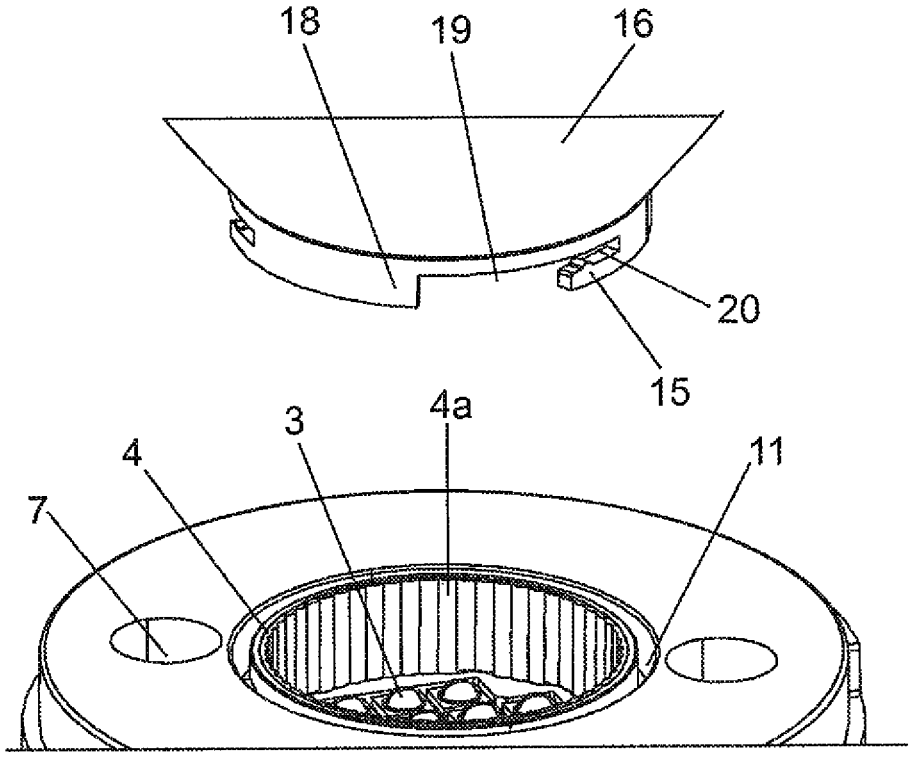
FIG. 4 shows the lighting module with the mounted element hanging above it in an enlarged section in an area of an internal bayonet holder.

FIG. 3 shows an inclined view of the lighting module 1 with an optical element as the mounted element in the form of a reflector 16 hanging above it. FIG. 4 shows the lighting module with the reflector 16 hanging above it in an enlarged section in an area of an internal bayonet holder 11. The reflector 16 has a cup-like, for example parabolic, shaped, reflecting inner side 17 and with a rear light inlet opening (not shown) can be placed on or near to the light outlet opening L of the optical waveguide element 4. For attachment to the lighting module 1, the reflector 16 has a rear bayonet base 18 for engagement with the inner (smaller) bayonet socket 11 of the lighting module 1. The bayonet base 18 has three longitudinal slots 19 and transverse slots 20 which are complementary to the bayonet socket, it being possible for a latching lug 15 to be located in the transverse slot 20. Similarly, another mounted element with a correspondingly larger bayonet base and a correspondingly larger light inlet opening can also be placed on the outer bayonet socket 12.

Figure 5:
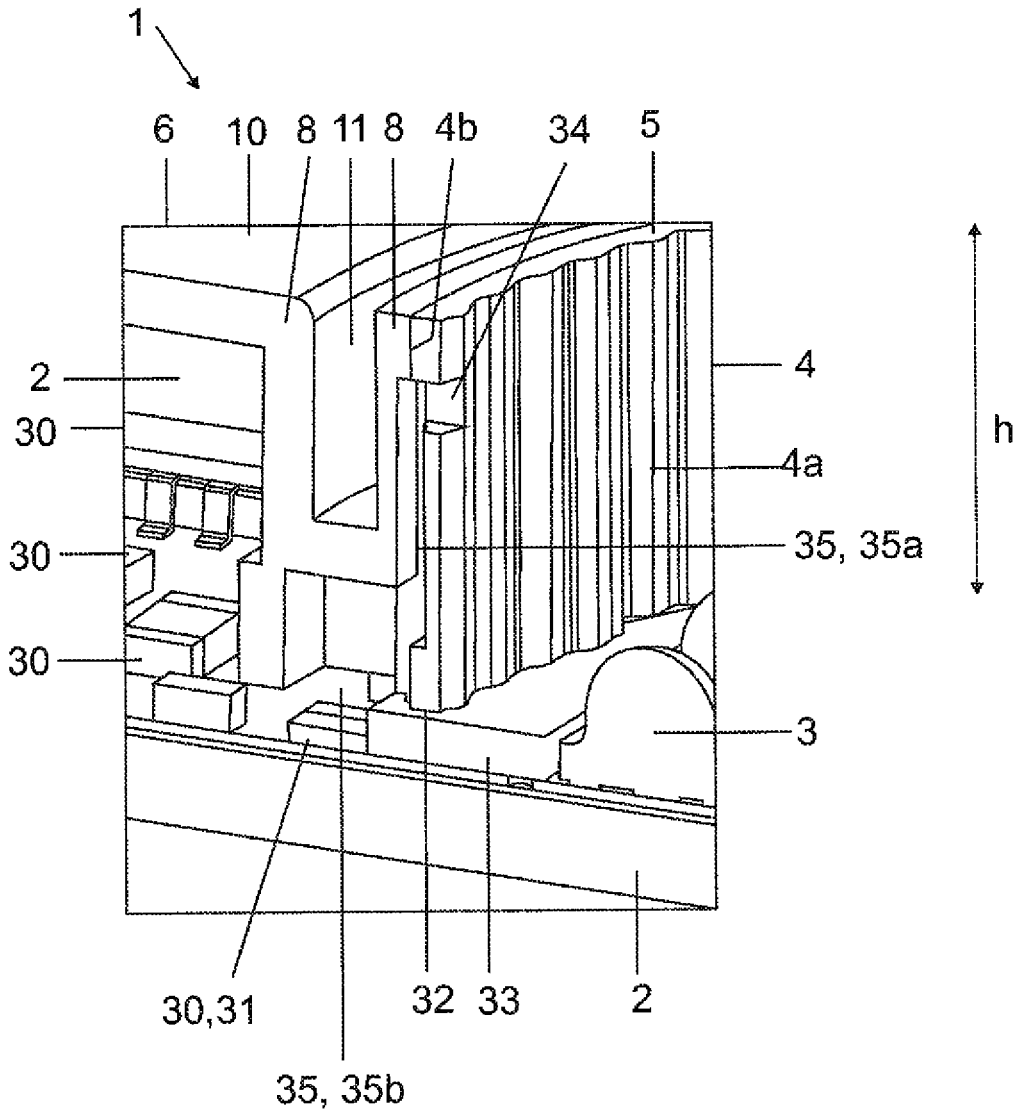
FIG. 5 shows a section of FIG. 2 in the area of a window of an optical waveguide element.

FIG. 5 shows a section of the lighting module of FIG. 2 in the area of the window 34 of the optical waveguide element 4. The window 34 is a rectangular lead-through or cut-out through the optical waveguide element 4. In order to scan as much information as possible from all light emitting diodes, the window 34 is located in one front third of the optical waveguide element. For an adequately intensive light incidence on the light sensor 31, the window 34 has a vertical extension of at least 10% to 15% of a height h of the optical waveguide element 4.

A hollow light channel 35 adjoins the window 34 along an outer side 4*b* of the optical waveguide element 4. The light channel 35 is also formed on or by the annular cover 6 and leads to the light sensor 31. Stated more precisely, the light channel 35 has a first section 35*a* which, adjoining the window 34, is formed or delimited partially by the optical waveguide element 4 (in particular its outer side 4*b*) and partially by the annular cover 6 (in particular its inner wall 8). The first section 35*a* leads from the window 34 vertically downwards to a second section 35*b*. The second section 35*b* runs into the volume covered by the annular cover 6 or into the inner space of the annular cover 6 in which the light sensor 31 is also housed. The second section 35*b* optically connects the first section 35*a* to the light sensor 31. In order to avoid light loss, for example by absorption, the walls bounding the first section 35*a* and/or bounding the second section 35*b* of the light channel 35 are made reflecting. So, for example, the outer side 4*b* of the optical waveguide element 4 can be made reflecting, in particular mirrored, either wholly or at least in the area of the light channel 35. Similarly, the inner wall 8 of the annular cover 6 can be made reflecting, in particular mirrored, either wholly or at least in the area of the light channel 35.

All in all, light emitted by a plurality of light emitting diodes 3, which falls through the window 34, can therefore pass through the (optional, at least area-wise, reflecting) first comparatively narrow section 35*a* of the light channel 35 and then pass through the (optional, at least area-wise, reflecting) wider second section 35*b* of the light channel 35 to the light sensor 31.

Altogether, this results in simple and economic convertible light transmission to the light sensor 31.

Figure 6:
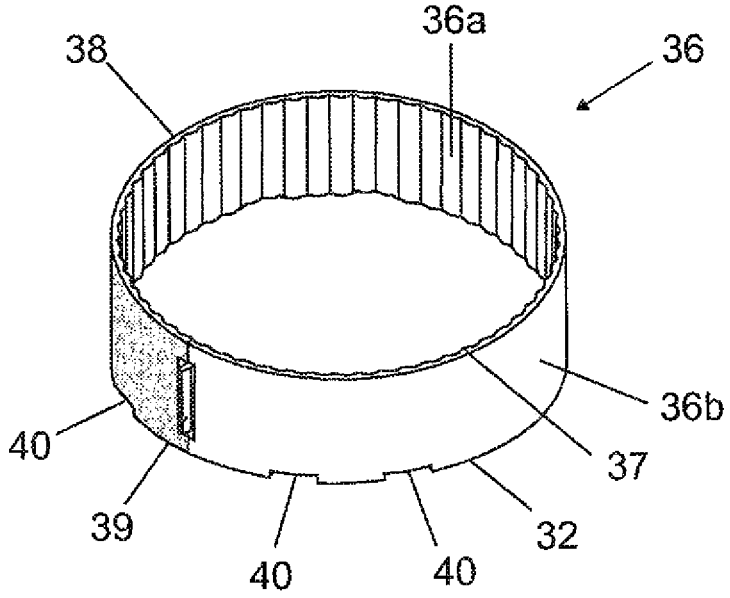
FIG. 6 shows an optical waveguide element according to a second embodiment.

FIG. 6 shows an optical waveguide element 36 according to a second embodiment. Like the optical waveguide element 4, the inner side 36*a* of the optical waveguide element 36 is provided with a corrugated-type texture for improved light mixing. The hollow-cylinder optical waveguide element 36 is now in two parts; composed of a first half 37 shown light and a second half 38 shown dark. At their adjoining or neighboring edges the two halves 37, 38 are in each case latched by means of a latching lock or a latching connection 39. An optical waveguide element 36 can also be simply produced with a complex surface and also simply assembled in this way. In this case, to simplify the illustration the window is not shown.

If the optical waveguide element 36 is electrically conductive, for example on account of an electrically conductive coating or is constructed as a metallic main body, the lower edge 32 can have at least one cut-out 40 to avoid problems due to creepage paths.

Figure 7:
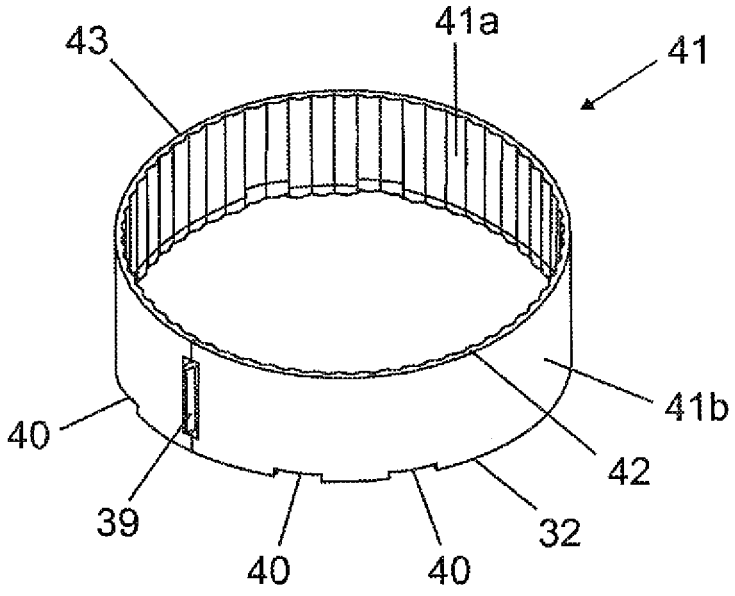
FIG. 7 shows an optical waveguide element according to a third embodiment.

FIG. 7 shows an optical waveguide element 41 according to a third embodiment.

The optical waveguide element 41 also has the corrugated texture on its inner side 41*a* and is assembled in two parts composed of a first half 42 and a second half 43. The two halves 42, 43 are likewise latched at their adjoining or neighboring edges by means of a latching connection 39.

The optical waveguide element 41 now has a hollow cylinder main body made of a light-transmitting, in particular transparent material, for example PMMA or glass. At its outer side 41*b* (alternately or additionally at its inner side 41*a*) the main body is covered with a non-transparent, in particular reflecting layer (for example a layer of BEF (brightness enhancement film)). The window 34 is formed by a cut-out in the non-transparent layer, which in this case leaves the latching connection 39 blank. Consequently, the window 34 is formed through or at the latching connection 39.

The scope of protection of the invention is not limited to the examples given hereinabove, the invention is embodied in each novel characteristic and each combination of characteristics, which includes every combination of any features which are stated in the claims, even if this feature or combination of features is not explicitly stated in the examples.

The invention claimed is:

1. A lighting module, comprising:

a printed circuit board having a front side populated by a plurality of light sources as well as at least one light sensor;

a hollow optical waveguide element which laterally surrounds all of the light sources on the printed circuit board circumferentially; and a cover at least for the light sensor arranged on the printed circuit board externally to the optical waveguide element, and having a hollow light channel formed in and/or on the cover in communication with the at least one light sensor, wherein the optical waveguide element has a window in communication with the hollow light channel to communicate light from the plurality of light sources to the hollow light channel and the at least one light sensor.

2. The lighting module as claimed in claim 1, wherein the light channel is formed adjacent to the window, at least in sections, partially by the optical waveguide element and partially by the cover.

3. The lighting module as claimed in claim 2, wherein the light channel adjacent to the window, is initially partially formed by the optical waveguide element and partially by the cover and then runs into a volume covered by the cover.

4. The lighting module as claimed in claim 1, wherein the optical waveguide element, has at least one reflecting region.

5. The lighting module as claimed in claim 1, wherein the window is a cut-out formed in the optical waveguide element.

6. The lighting module as claimed in claim 1, wherein the optical waveguide element comprises a light-transmitting, material and is covered by a non-transparent layer, it being possible for the window to be formed by a cut-out in the non-transparent layer.

7. The lighting module as claimed in claim 6, wherein the two adjacent parts of the optical waveguide element can be interconnected by at least one latching lock, and wherein the window is formed by the at least one latching lock.

8. The lighting module as claimed in claim 6, wherein the optical waveguide element is transparent, and the non-transparent layer is reflecting.

9. The lighting module as claimed in claim 1, wherein the optical waveguide element has the basic form of a hollow cylinder.

10. The lighting module as claimed in claim 1, wherein the optical waveguide element is electrically conductive, is connected via a lower edge to the printed circuit board and has at least one cut-out at the lower edge.

11. The lighting module as claimed in claim 1, wherein the optical waveguide element is a separate component from the cover, and is constructed in at least two parts.

12. The lighting module as claimed in claim 1, wherein the two adjacent parts of the optical waveguide element can be interconnected by at least one latching lock.

13. The lighting module as claimed in claim 1, wherein the optical waveguide element is integrated in the cover.

14. The lighting module as claimed in claim 1, wherein said light sources comprise light emitting diodes.

15. A lighting module, comprising:

a printed circuit board having a front side populated by at least one light source as well as at least one light sensor;

a hollow optical waveguide element which laterally surrounds the at least one light source circumferentially; and a cover at least for the light sensor arranged on the printed circuit board externally to the optical waveguide element, and having a hollow light channel formed in and/or on the cover in communication with the at least one light sensor, wherein the optical waveguide element has a window in communication with the hollow light channel to communicate light from the at least one light source to the hollow light channel and the at least one light sensor, and wherein the window is located in a front third of the optical waveguide element.

16. A lighting module, comprising:

a printed circuit board having a front side populated by at least one light source as well as at least one light sensor;

a hollow optical waveguide element which laterally surrounds the at least one light source circumferentially; and a cover at least for the light sensor arranged on the printed circuit board externally to the optical waveguide element, and having a hollow light channel formed in and/or on the cover in communication with the at least one light sensor, wherein the optical waveguide element has a window in communication with the hollow light channel to communicate light from the at least one light source to the hollow light channel and the at least one light sensor, and wherein the window has a vertical extension of at least 10% to 15% of the height of the optical waveguide element.

17. A lighting module, comprising:

a printed circuit board having a front side populated by at least one light source as well as at least one light sensor;

a hollow optical waveguide element, which laterally surrounds the at least one light source circumferentially; and a cover at least for the light sensor arranged on the printed circuit board externally to the optical waveguide element, and having a hollow light channel formed in and/or on the cover in communication with the at least one light sensor, wherein the optical waveguide element has a window in communication with the hollow light channel to communicate light from the at least one light source to the hollow light channel and the at least one light sensor, and wherein the cover is an annular cover, which surrounds the optical waveguide element in the form of a ring and in addition to the light sensor, covers additional electronic components mounted on the printed circuit board.

* * * * *